US009366985B1

(12) United States Patent
Seki et al.

(10) Patent No.: US 9,366,985 B1
(45) Date of Patent: Jun. 14, 2016

(54) ELECTRIC CHARGING-DISELECTRIFYING DEVICE, PROCESS CARTRIDGE WITH ELECTRIC CHARGING-DISELECTRIFYING DEVICE, AND IMAGE FORMING APPARATUS WITH PROCESS CARTRIDGE

(71) Applicants: Hideyasu Seki, Chiba (JP); Satoshi Hatori, Kanagawa (JP); Takeshi Fukao, Kanagawa (JP); Yuta Kawashima, Kanagawa (JP)

(72) Inventors: Hideyasu Seki, Chiba (JP); Satoshi Hatori, Kanagawa (JP); Takeshi Fukao, Kanagawa (JP); Yuta Kawashima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/979,129

(22) Filed: Dec. 22, 2015

(30) Foreign Application Priority Data

Dec. 22, 2014 (JP) ..... 2014-259087

(51) Int. Cl.
*G03G 21/00* (2006.01)
*G03G 15/02* (2006.01)

(52) U.S. Cl.
CPC ..... *G03G 15/0233* (2013.01)

(58) Field of Classification Search
USPC ..... 399/127–129, 343, 349
See application file for complete search history.

(56) References Cited

U.S. PATENT DOCUMENTS 6,208,819 B1 * 3/2001 Pai ..... G03G 21/06 399/128

FOREIGN PATENT DOCUMENTS

| | | |
|---|---|---|
| JP | 2008-158111 | 7/2008 |
| JP | 2013-007813 | 1/2013 |
| JP | 2013-195834 | 9/2013 |

* cited by examiner

*Primary Examiner* — Hoan Tran
(74) *Attorney, Agent, or Firm* — Duft Bornsen & Fettig LLP

(57) ABSTRACT

An electric charging-diselectrifying device includes an electric charging member that contacts an image bearer to form an electric charging nip between the electric charging member and the image bear. The electric charging member electrically charges multiple electric charge regions in the image bearer located both upstream and downstream of the electric charging nip in a direction of rotation of the image bearer. An electric charge removing device is provided to remove electric charge borne on the image bearer by irradiating the multiple electric charging regions of the image bearer with light. The electric charging member is made of a material that allows the light emitted from the electric charge removing device to penetrate the electric charging member.

20 Claims, 8 Drawing Sheets

FLUCTUATION OF VD WHEN RESISTANCE AND RZ ARE HIGH
(ABSENCE OF LIGHT SHIELDING VC-680V)

FLUCTUATION OF VD WHEN RESISTANCE VALUE IS REF R
(ABSENCE OF LIGHT SHIELDING VC-680V)

ELECTRIC CHARGING-DISELECTRIFYING DEVICE, PROCESS CARTRIDGE WITH ELECTRIC CHARGING-DISELECTRIFYING DEVICE, AND IMAGE FORMING APPARATUS WITH PROCESS CARTRIDGE

CROSS-REFERENCE TO RELATED APPLICATION

This patent application is based on and claims priority pursuant to 35 U.S.C. §119 (a) to Japanese Patent Application No. 2014-259087, filed on Dec. 22, 2014, in the Japan Patent Office, the entire disclosure of which is hereby incorporated by reference herein.

BACKGROUND

1. Technical Field

Embodiments of this invention relate to an electric charging-diselectrifying device, a process cartridge with the electric charging-diselectrifying device, and an image forming apparatus with the process cartridge.

2. Related Art

A large number of image forming apparatuses employ electro-photographic systems and include organic photoconductors (OPCs: Organic Photoconductors) as image bearers. In such a photoconductor, a so-called residual image (i.e., a past record of an image), such as a ghost, a photo memory, etc., sometimes appears in a new image. The residual image generally occurs when either a pretransfer potential or a transfer current is uneven due to existence of light and shade in a toner image formed right before and accordingly a potential of the photoconductor is not uniform (uneven) in a longitudinal direction thereof right before an electric charging process is executed thereon.

SUMMARY

Accordingly, one aspect of the present invention provides a novel electric charging-diselectrifying device that includes an electric charging member that contacts an image bearer to form an electric charging nip N between the electric charging member and the image bear. The electric charging member electrically charges multiple electric charge regions in the image bearer located both upstream and downstream of the electric charging nip in a direction of rotation of the image bearer. The electric charging-diselectrifying device further includes an electric charge removing device that removes electric charge borne on the image bearer by irradiating the multiple electric charging regions of the image bearer with light. The electric charging member is made of a material that allows the light emitted from the electric charge removing device to penetrate the electric charging member.

Another aspect of the present invention provides a novel process cartridge detachably attachable from and to a main unit of an image forming apparatus as a single unit. The process cartridge includes an image bearer to bear an electrostatic latent image thereon, the above-described electric charging-diselectrifying device, and at least one of a developing device to render the electrostatic latent image visible as a toner image on the image bearer, a transfer device to transfer the toner image onto a recording medium, and a cleaner to clean the image bearer after the transfer device transfers the toner image onto the recording medium.

Yet another aspect of the present invention provides a novel image forming apparatus that includes an image bearer to bear an electrostatic latent image thereon, a developing device to render the electrostatic latent image visible as a toner image on the image bearer, and the above-described electric charging-diselectrifying device.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

In the above-described image forming apparatus, as a drum type photoconductor rotates, a surface of the photoconductor accordingly moves as well. As such movement proceeds, an electric charging process of electrically charging the surface of the photoconductor with an electric charging member, an electrostatic latent image forming process of forming an electrostatic latent image by exposing the electrically charged surface of the photoconductor with an exposing device, and a developing processes of developing the electrostatic latent image to be a toner image with a developing device are executed. Similarly, a transfer process of transferring the toner image with a transfer device from the surface of the photoconductor onto a recording medium such as a paper sheet, sheet, etc., is subsequently executed, thereby forming a toner image thereon. In this type of image forming apparatus, at either an initial stage or a repeatedly executed printing stage, the above-described phenomenon known as the residual image may occur, in which a history of a previously executed optical writing process on the photoconductor appears in an image formed in a subsequent process as illustrated in FIGS. 8 and 9.

Figure 8:
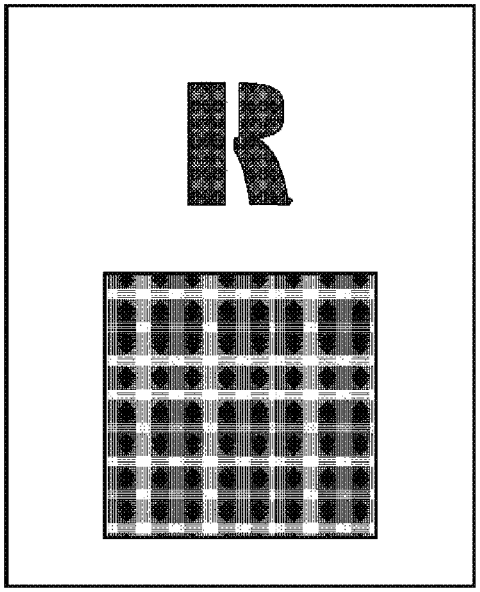
FIG. 8 is a diagram illustrating a normal image formed in a comparative example of an image forming apparatus.
Figure 9:
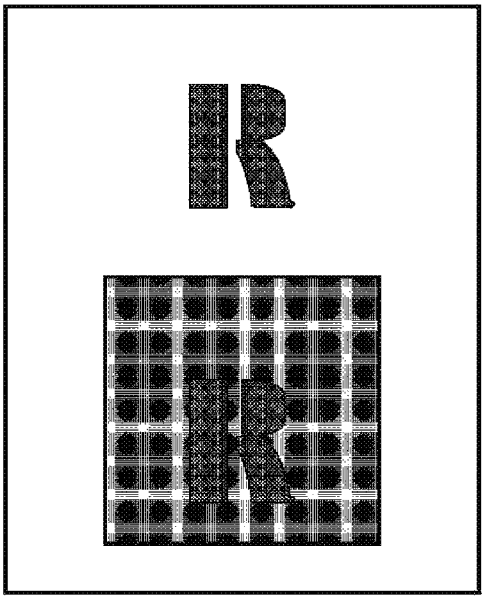
FIG. 9 is a diagram illustrating an exemplary image formed in the comparative example of an image forming apparatus with a residual image thereon.

That is, FIG. 8 is a diagram illustrating a normal image formed in an image forming apparatus without the ghost. By contrast, FIG. 9 is a diagram illustrating abnormal image formed in the image forming apparatus with the ghost. In the image forming apparatus, for example, when a halftone image is printed next to an image with clear contrast as shown in FIG. 8, although it is expected to be uniform, a (previously) printed image pattern sometimes floats to a front surface of the halftone image as shown in FIG. 9.

Such degradation of image quality is called either a positive residual image or a positive ghost, and is particularly inhibited from occurring in a high quality full-color image forming apparatus.

Figure 10A:
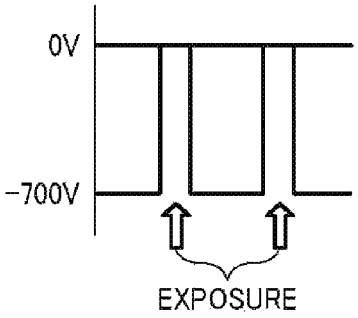
FIGS. 10A, 10B, and 10C are schematic diagrams collectively illustrating an exemplary change in surface potential generated in a photoconductor caused when each of a latent image forming process, a developing process, and a toner image transfer processes is executed normally in the comparative example of the image forming apparatus.
Figure 10B:
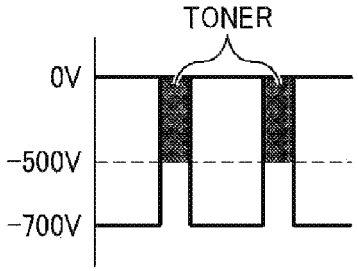
Figure 10C:
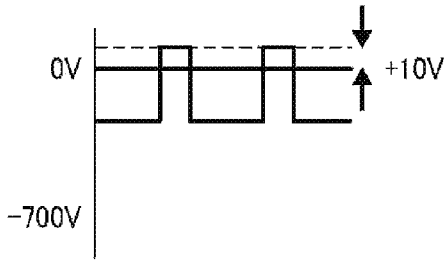
Figure 11A:
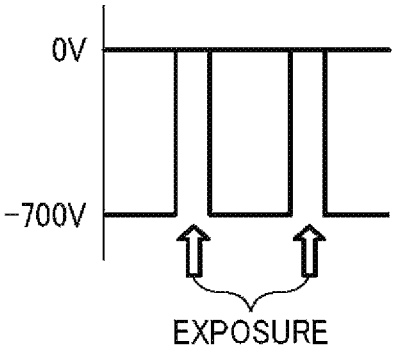
FIGS. 11A, 11B, and 11C are schematic diagrams also collectively illustrating an exemplary change in surface potential of the photoconductor caused when each of the latent image forming process, the developing process, and the toner image transfer processes is executed abnormally while forming a positive residual image in the comparative example of the image forming apparatus.
Figure 12A:
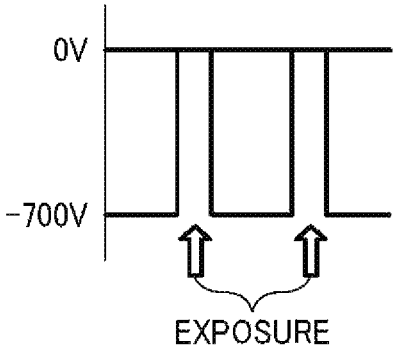
FIGS. 12A, 12B, and 12C are schematic diagrams also collectively illustrating an exemplary change in surface potential of the photoconductor caused when each of the latent image forming process, the developing process, and the toner image transfer processes is abnormally executed while forming a negative residual image in the comparative example of the image forming apparatus.
Figure 11B:
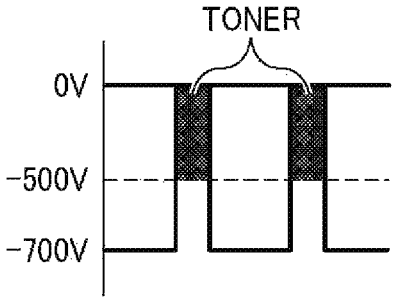
Figure 12B:
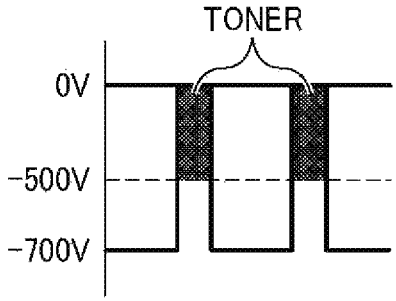
Figure 11C:
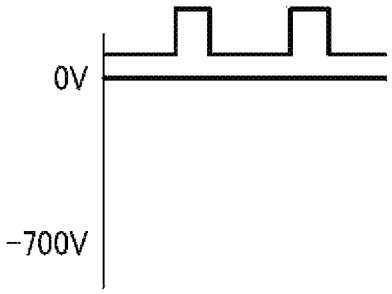
Figure 12C:
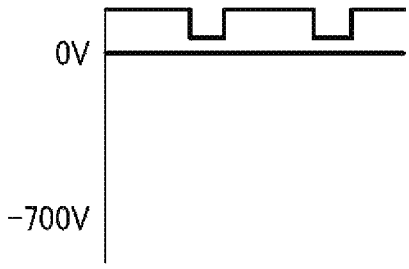

Various mechanisms may cause the above-described residual image. One of the mechanisms is a change in surface potential of the photoconductor as shown in FIGS. 10A, 10B, and 10C, FIGS. 11A, 11B, and 11C, and FIGS. 12A, 12B, and 12C. That is, FIGS. 10A, 10B, and 10C are diagrams schematically illustrating the change in surface potential of the photoconductor caused when a latent image forming process, a developing process, and a toner image transfer process are executed while forming the normal image. By contrast, FIGS. 11A, 11B, and 11C are diagrams schematically illustrating the change in surface potential of the photoconductor caused when the latent image forming process, the developing process, and the toner image transfer process are executed while forming the abnormal image of the positive residual. FIGS. 12A, 12B, and 12C are diagrams also schematically illustrating the change in surface potential of the photoconductor caused when the latent image forming process, the developing process, and the toner image transfer process are executed while forming the abnormal image of the negative residual.

Now, the change in surface potential of the photoconductor caused when the latent image forming process, the developing process, and the toner image transfer process are executed while forming the positive residual image is described in greater detail with reference to FIGS. 10A to 10C. When an electrostatic latent image is formed as shown in FIG. 10A, a surface of the photoconductor is electrically charged uniformly to bear about −700 V, for example. The surface of the photoconductor is then exposed to light having image information to bear a potential of an approximately 0 V at each of exposed portions thereon as shown by arrows in the drawing. Subsequently, when the developing process is executed, toner is attracted to the surface of the photoconductor in accordance with a difference between a developing potential (bias) and a surface potential of the photoconductor as shown in FIG. 10B. When the transfer process is executed thereafter, the toner image is transferred by a transfer device from the photoconductor onto a recording medium such as a paper sheet, etc., positively electrically charged beforehand.

In the next step, as shown in FIG. 10C, a reverse bias voltage is generated in the photoconductor by the transfer device in a transfer process. That is, a surface potential of the photoconductor shifts in a positive direction as a whole and a potential of the exposed portion thereof exceeds about 0 V after completing the transfer process. As a result, a polarity of the potential of the exposed portion is reversed to be positive (i.e., about +10 V in the drawing). Hence, when the latent image forming process, the developing process, and toner image transfer processes are repeated in this way, even though the surface of the photoconductor is uniformly negatively charged by an electric charging device prior to the next exposing process, the surface potential of the exposed portion of the photoconductor previously shifting in the positive direction by a prescribed amount is yet close to the positive side by the prescribed amount thereof. As a result, since the surface portion of the photoconductor with the potential shifting to the positive side causes a larger difference in developing potential than that of the other portion thereof, a dark toner image is forcibly formed in the surface portion of the photoconductor as a result. Accordingly, this surface portion of the photoconductor is recognized as the positive residual image in an image formed next as a result.

Similarly, as shown in FIGS. 11A, 11B, and 11C, when a surface potential of the photoconductor becomes positive as a whole after the transfer process is completed thereby relatively increasing an absolute value of a potential of an image portion, the image portion also provides the positive residual image again as a result. By contrast, as shown in FIGS. 12A, 12B, and 12C, when toner inhibits transfer current from flowing in and accordingly a potential of an image portion shifts to the negative side, the image portion provides the negative residual image (i.e., the negative ghost) as a result.

Further, a beam spot that writes a dot having a prescribed shape generally slightly includes illuminance distribution therein. Hence, when a surface portion of the photoconductor with a charged potential shifting toward the positive side is irradiated with the beam spot, an outline of a developed dot spreads by an amount of offset of a surface potential toward the low voltage side, thereby increasing a diameter and accordingly expanding the dot. Consequently, since an image is formed by unnecessarily enlarged dots and looks thicker when it is viewed as a whole, the positive residual image is again recognized as well.

When the dot diameter increases in this way, the residual image is more apparently recognized as the image with a higher resolution, for example about 1200 dpi (dot per inch) higher than about 600 dpi, is output. In this way, when an electro-photographic image forming apparatus increases the resolution, this problem grows to a serious level. To prevent occurrence of such a residual image, it is generally effective to eliminate an electric charge from the surface of the photoconductor by using an electric charge removing device in a preprocessing process implemented before the electric charging process.

That is, since the electric charge removing device can generate a positive electric charge on the photoconductor, a negatively charged portion of the residual image as illustrated in FIGS. 10A, 10B, and 10C can be especially effectively eliminated to bear near about 0 V. It is also effective in suppressing the residual images as shown in FIGS. 11A to 12C as well that an amount of light is increased. That is, influence of the positive electric charge remaining on the photoconductor after passing through a transfer nip is decreased.

Figure 13:
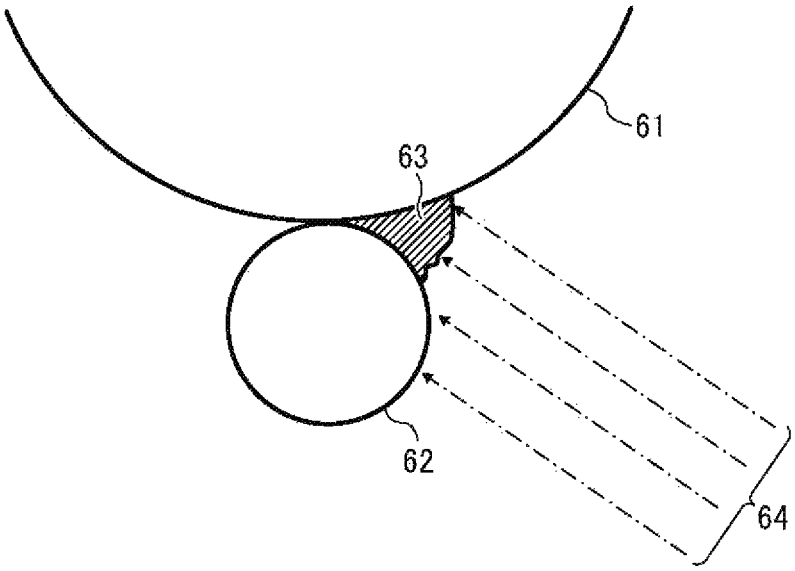
FIG. 13 is a diagram schematically illustrating an aspect of a related art when light is directed onto an electric charging nip as an electric charging process is being executed.

As shown in FIG. 13, there is a more effective system capable of suppressing the residual image of FIGS. 11A to 12C than the above-described exposure system. That is, FIG. 13 schematically illustrates an aspect, in which the light is irradiated as the electric charge process is being executed. According to this system, the light 64 is irradiated to an electric charging region 63 formed between an electric charging roller 62 acting as an electric charging member and the photoconductor 61. Hence, although a percentage of an electric charge, which is generated in the photoconductive layer of the photoconductor 61 and comes up to a surface of the photoconductor 61, decreases when the positive electric charge remains on the surface of the photoconductor 61, an amount of positive electric charges borne on the surface of the photoconductor 61 can be reduced. Because, the surface of the photoconductor 61 is electrically charged as the electric charge is being removed from the surface of the photoconductor 61. For this reason, the electric charge generated in the photoconductive layer easily moves toward the surface of the photoconductor 61. Hence, the positive electric charge existing either inside or on the surface of the photoconductor 61 can be more effectively removed. However, an intensive light is needed thereby causing an increase in the cost and is impractical.

To solve such a problem of the residual image, the below described various countermeasures can be taken. First, a lubricant coating mechanism is sometimes provided in a cleaner that cleans a photoconductor unit (PCU) to reduce an amount of positive electric charge of a transfer current that tends to reach the photoconductor. Second, an electric charge voltage (VL) is increased and set to a higher level to reduce unevenness of a potential caused before the transfer process is executed. Third, a thickness of a toner layer is decreased to avoid a transfer current from unevenly flowing thereinto. However, in the first countermeasure, the lubricant coating mechanism raises the cost and is impractical. In the second countermeasure, increasing in electric charge voltage to the higher level needs an AC (Alternating Current) component in a high voltage power supply (HVP) that supplies power to a developing system thereby raising the cost again. In the third countermeasure, decreasing in thickness of the toner layer reduces a margin of avoiding toner from dropping from the toner layer.

As yet another countermeasure, a system of erasing an image memory by using an exposing device has been proposed. In such a system, however, the photoconductor needs to rotate once more before or after a printing operation (i.e., a printing job) is started or completed. This accordingly increases a waiting time when at least multiple printing jobs are intermittently requested and is impractical. To avoid increasing in such waiting time in such a system, an electric charge removing lamp may be employed as a countermeasure to remove an electric charge. However, when the electric charge removing lamp is installed simply to irradiate the photoconductor with light prior to an electric charging process to remove electric charge borne thereon, the photoconductor needs to be irradiated with significantly intensive light. In such a situation, to suppress a ripple but obtain intensity of the light at the same time, the number of light emitting elements needs to be increasingly installed in the electric charge removal lamp, thereby raising the cost again.

In addition, since the photoconductor is fatigued with the light, electric charging and exposing characteristics of the photoconductor are easily impacted, thereby being unable to obtain a long life thereof. When a non-contact type electric charging system, such as a corona electric charging system, an AC (Alternating Current) electric charging system, etc., is employed to simultaneously remove an electric charge at the same time when an electric charging process is executed, the images memory can be erased indeed. However, ozone is unnecessarily output as a side effect as a result.

For this reason, it is demanded to suppress occurrence of the residual image without incurring the side effect of the dropping of toner from the toner layer, the increasing in waiting time, and the increasing in an amount of outputs of ozone while reducing the cost.

To solve the above-described various problems, in a conventional image forming apparatus that includes an electrophotographic photoconductor composed of a conductive substrate, an under coat layer made of conductive metal oxide and electron accepting material collectively placed on the conducting substrate, a photoconductive layer placed on the under coat layer, an electric charging member that electrically charges a surface of the electro-photographic photoconductor, an exposing device that exposes the above-described charged surface of the electro-photographic photoconductor to light to form an electrostatic latent image thereon, a developing device that accommodates developer containing toner and renders the electrostatic latent image visible with the developer to form a toner image, and a transfer device that transfers the toner image borne on the surface of photoconductor onto a recording medium, when image formation restarts after once it is stopped, the above-described exposing device entirely exposes the surface of the electro-photographic photoconductor before the surface thereof is electrically charged by the electric charging member.

However, an extremely intensive light is needed to reduce the residual image if it is simply emitted before the electric charging process is executed. Further, when such an extremely intensive light is always and repeatedly used to remove the electric charge borne on the photoconductor, the photoconductor is fatigued with the light to some degree. As a result, a residual potential grows while decreasing toner adhesion density thereby degrading image quality as a problem. Further, in the intermittent operations of the above-described conventional image forming apparatus, a downtime period is also prolonged as a problem.

Accordingly, various embodiments of the present invention are intended to offer an electric charging-diselectrifying device capable of suppressing occurrence of a residual image generally caused when either printing operation is repeated or a residual potential of a photoconductor increases while decreasing a waiting time or the like.

Figure 1:
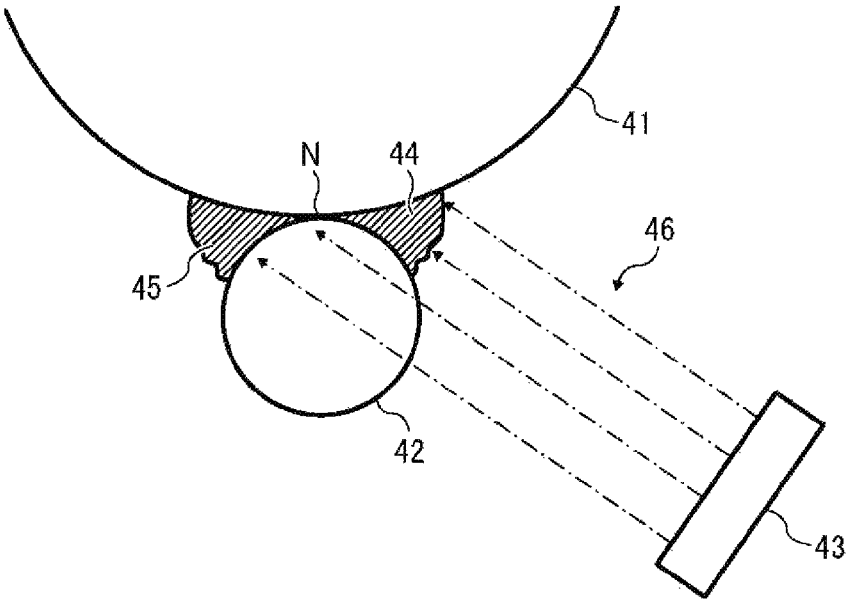
FIG. 1 is a schematic diagram illustrating a basic configuration of a principal part of an exemplary process cartridge according to a first embodiment of the present invention.

Referring now to the drawings, wherein like reference numerals designate identical or corresponding parts throughout the several views thereof, and in particular to FIG. 1, a basic configuration of a principal part of a process cartridge according to a first embodiment of the present invention is described.

The process cartridge 40 of this embodiment of the present invention at least includes a photoconductive drum 41 acting as an image bearer, an electric charging roller 42 acting as an electric charging member, and an electric charge removing lamp 43 that emits an light 46 as an electric charge removing device. The process cartridge 40 is configured to be detachably attached to the image forming apparatus as a single unit. The photoconductive drum 41 and the electric charging roller 42 contact each other while forming an electric charging nip N therebetween. A pair of electric charging regions 44 and 45 is accordingly formed in both upstream and downstream of the electric charging nip N in a direction of movement of a surface of the photoconductive drum 41. In the first embodiment of the present invention, the electric charging roller 42 and the electric charge removing lamp 43 collectively constitute an electric charging-diselectrifying device.

Beside the photoconductive drum 41 and the electric charging roller 42, the process cartridge 40 also includes at least one of an exposing device to expose the photoconductive drum 41 to the light, a developing device to develop a latent image on the photoconductive drum 41, a transfer device to transfer a toner image from the photoconductive drum 41 onto a recording medium such as a paper sheet, etc., and a cleaner to clean the surface of the photoconductive drum 41. The developing device at least includes a developer container that accommodates either toner or the above-described developer therein and a developer bearer to bear and convey either the toner or the developer accommodated in the developer container. The developing device also includes a layer thickness regulating member or the like to regulate a thickness of a toner layer to be borne (i.e., stacked) thereon.

The photoconductive drum 41 includes a conductive substrate and at least a photoconductive layer formed on the conductive substrate. In addition, as a surface layer of the photoconductive drum 41, a protective layer is also desirably formed thereon. That is, by providing the protective layer on the surface thereof, a film of a photoconductor of the photoconductive drum 41 is hardly scraped off. In addition, with this, even if the photoconductor of the photoconductive drum 41 is positively charged after a transfer process is completed, it can be constantly charged electrically when a negative electric charge is applied thereto, and accordingly, the residual image may be avoided from becoming serious.

In this embodiment of the present invention, the electric charging roller 42 is made of a material that allows penetration of the light 46. Thus, the electric charge removing lamp 43 directly emits the light 46 to an electric charging region 44 formed upstream of the electric charging nip N of the photoconductive drum 41 thereby removing the electric charge borne thereon. At the same time, the electric charge removing lamp 43 emits the light 46 to an electric charging region 45 formed downstream of the electric charging nip N thereof through the electric charging roller 42 thereby removing the electric charge borne thereon as well. In this embodiment of the present invention, a transmittance of the electric charging roller 42 that allows penetration of the light is set to about ten percent (10%) or more.

Further, a surface layer film including fine insulating and transparency particles is provided to overlie the surface of the electric charging roller 42. The electric charging roller 42 includes a base material made of polyurethane or the like. The electric charging roller 42 has a uniform transmittance to uniformly allow the light 46 to penetrate the electric charging roller 42. Here, beside the uniform transmittance, the electric charging roller 42 needs an electrical conductivity on the other hand. Because of this, the electric charging rollers 42 is made of carbon and a rate of carbon content thereof is from about 10% to about 70%. Further, an error of a thickness of the surface layer film is about ±2 μm or less. That is, when the rate of carbon content is below about 10%, the electrical conductivity of the electric charging rollers 42 is no longer ensured. By contrast, when the rate of carbon content exceeds about 70%, the transparency of the electric charging rollers 42 becomes impractical. When the error of the surface layer film exceeds about ±2 μm, the light 46 scatters due to the surface layer film, and is accordingly no longer uniformly directed onto the electric charging region 45 as a result. By contrast, however, with the above-described preferable values, occurrence of the residual image can be effectively prevented or reduced in the process cartridge 40.

Now, a background of a brightness of the electric charging roller 42 to be about 70 degrees (corresponding to a transmittance of about 10%) or more is described. A degree of transparency of the electric charging roller 42 is determined based on the below described measurement result to be a value that renders a rank of a residual image higher than the level four. The rank of a residual image is obtained based on a visual evaluation of an image printed with a halftone toner adhesion density in accordance with the below described criteria.

That is, as the criteria, a fifth rank is assigned when the residual image does not appear at all. A fourth rank is assigned when the residual image slightly occurs and is recognized but at an acceptable level. A third rank is assigned when the residual image occurs thereby raising a practical problem. Each of first and second ranks is assigned when the residual image is apparently recognized and practical use thereof is prohibited.

Specifically, these ranks are practically determined as follows. To the image forming apparatus having the exposing device, the process cartridge 40 including the developing device is attached. The exposing device then forms an electrostatic latent image on the photoconductive drum 41. Subsequently, the photoconductive drum 41 is rotated once more and the exposing device forms an electrostatic latent image again on the photoconductive drum 41. The electrostatic latent image is then visualized as a toner image (i.e., developed) and a toner adhesion density (A) thereof is subsequently measured. Meanwhile, in a surface portion of the photoconductive drum 41, in which the electrostatic latent image is not formed by the exposing device, an electrostatic latent image is formed by the exposing device and is developed after the photoconductive drum 41 is similarly rotated once more. A toner adhesion density (B) of a developed image obtained in this way is then similarly detected and measured. Then, a difference in density between the toner adhesion densities (A) and (B) is measured and a relation between the difference in image density and the rank of a residual image is obtained as described herein below with reference to FIG. 2.

Figure 2:
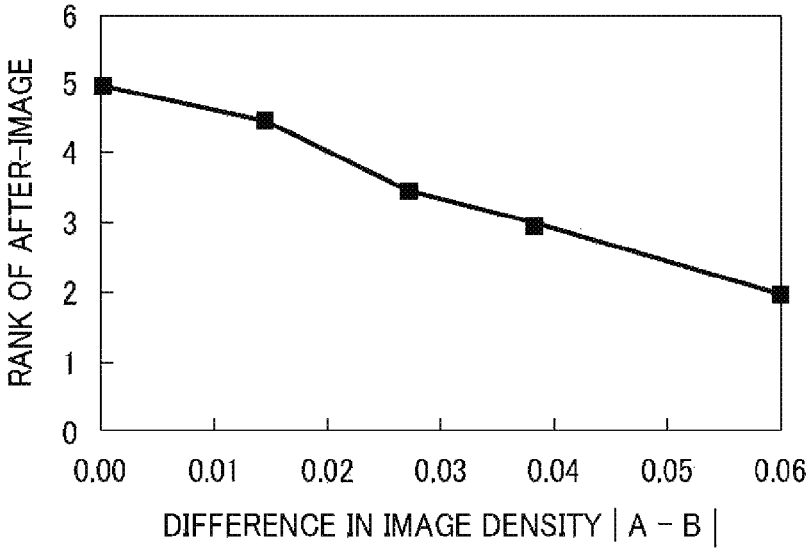
FIG. 2 is a chart illustrating an exemplary relation between a difference in image density and a rank of a residual image according to one embodiment of the present invention.

That is, FIG. 2 is a graph illustrating an exemplary relation between the difference in image density and the rank of a residual image. As shown there, in a halftone toner adhesion density, to render the rank of the residual image being the level four or more, the difference in toner adhesion density $|A-B|$ needs be about 0.02 or less. Here, the halftone toner adhesion density is generally a level between respective toner adhesion densities of a blank portion (i.e., a non-image portion) and a solid image portion. However, to more clearly recognize occurrence of the residual image, the toner adhesion density is preferably from about 10% to about 50% when it is premised that the blank portion is about 0% and that of the solid image portion is about 100%. A time to detect the toner adhesion density is not particularly limited, but is desirably other than when an image is printed.

Figure 3:
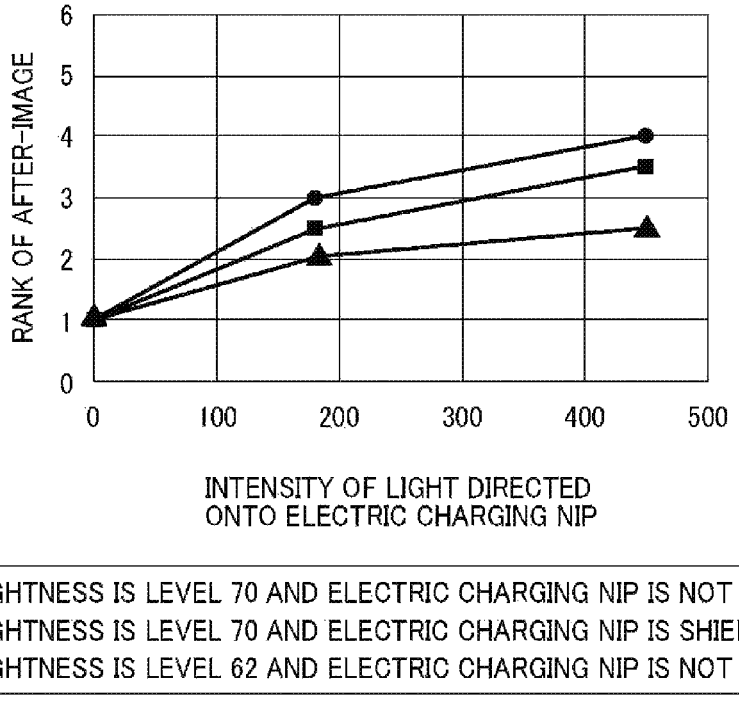
FIG. 3 is a chart illustrating an exemplary relation between a rank of a residual image and a degree of transparency of an electric charging roller when intensity of exposure light directed onto an electric charging nip is changed according to one embodiment of the present invention.

FIG. 3 is a graph illustrating an exemplary relation between an intensity of exposure light directed onto (i.e., reaching) the electric charging nip and a rank of a residual image per a degree of transparency of the electric charging roller. In this measurement result, the degree of transparency of the electric charging roller is represented by a brightness of a metal core of the electric charging roller. The brightness of the electric charging roller is measured by a scanner "ES-10000G" manufactured by Seiko Epson Corporation, for example. The measurement is implemented by scanning in an eight bit gray mode with a resolution of about 300-dpi. Then, a scan file obtained by the scanning in this way is opened by using software "ImageJ" provided by the American National Institute of Health (NIH), and the brightness of the metal core of the electric charging roller is acquired. Then, an average of the brightness is calculated and is regarded as a stein brightness of the electric charging roller.

As shown in FIG. 3, it is understood therefrom that the rank of the residual image can increase as both the degree of transparency (i.e., the brightness in the drawing) of the electric charging roller and an amount of light (i.e., the intensity of exposure light) increase. Furthermore, in a comparative example, in which the electric charging nip N is shielded by a prescribed shield, an effectiveness of suppressing the residual image decreases, because the electric charging nip N is shielded with the prescribed shield. Based on this result, it is noted that the rank of the residual image can be improved when the electric charging rollers 42 is transparent (i.e., made of transparent material). More specifically, when the brightness of the electric charging roller is increased to a level of about "70" or more, the rank of the residual image grows to the level four or more even when an intensity of light directed onto (i.e., reaching) the electric charging nip N is about 450 mW/m^2. As a result, the residual image can be effectively inhibited while minimizing the cost of the light. The brightness of about the level 70 measured in the above-described manner is equivalent to a transmittance of light of about 10% when it is converted. Hence, when the transmittance is below about 10%, the rank of the residual image is too low to be practically used in the process cartridge.

Figure 4A:
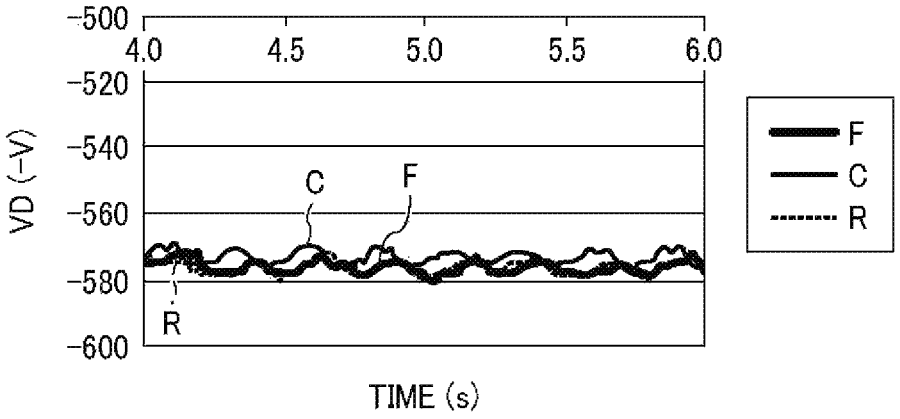
FIGS. 4A and 4B are charts collectively illustrating a potential unevenly generated on a surface of a photoconductor when the photoconductor is exposed to light after an electric charging process is executed according to one embodiment of the present invention.
Figure 4B:
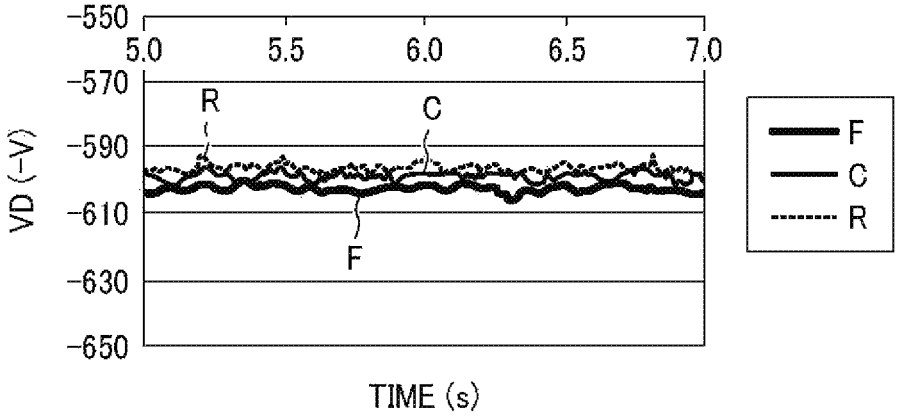

Further, the photoconductive drum 41 is configured to have a uniform transmittance as a whole to allow the light to penetrate the photoconductive drum 41 as well. That is, if the transmittance of the photoconductive drum 41 is not uniform, i.e., the transmittance thereof is uneven, the photoconductive drum 41 is unevenly electrically charged as a result as shown in FIGS. 4A and 4B. That is, each of FIGS. 4A and 4B is a graph illustrating an uneven state of a potential generated on the surface of the photoconductor when a light exposing process is executed after an electric charging process is completed. As shown in each of FIGS. 4A and 4B, an actually measured surface potential of the photoconductor is indicated.

Figure 5:
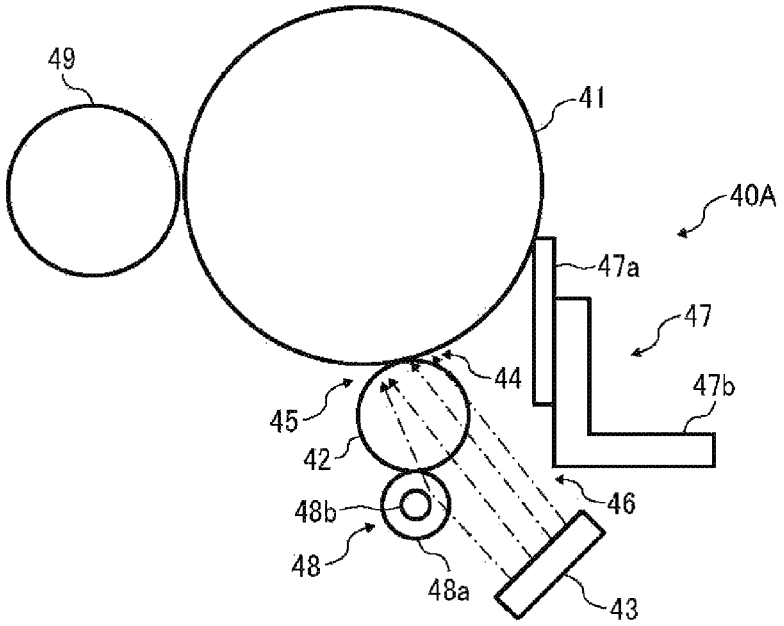
FIG. 5 is a schematic diagram illustrating a principal part of an exemplary process cartridge according to a second embodiment of the present invention.

Now, an exemplary process cartridge according to a second embodiment of the present invention is described with reference to FIG. 5. That is, as shown there, a principal part of the process cartridge 40A according to the second embodiment of the present invention is schematically illustrated. Beside the photoconductive drum 41 and the electric charging roller 42, the process cartridge 40A according to the second embodiment of the present invention includes a cleaner 47 for cleaning the photoconductive drum 41 and an electric charging roller cleaning roller 48 acting as an electric charging member cleaner. In the drawing, a reference numeral 49 indicates a developing roller included in the developing device to develop a latent image borne on the photoconductive drum 41.

In the second embodiment of the present invention with the above-described configuration, the electric charging rollers 42 accepts penetration of the light 46 again as in the first embodiment of the present invention as well. However, the cleaner 47 includes a cleaning blade 47*a* that contacts the photoconductive drum 41 and a base portion 47*b* that holds the cleaning blade 47*a*. The electric charging roller cleaning roller 48 contacts and cleans the electric charging roller 42. The electric charging roller cleaning roller 48 includes a cylindrical cleaning layer 48*a* and a core member 48*b* arranged at an interior center of the cylindrical cleaning layer 48*a*.

The cleaning layer 48*a* of the electric charging roller cleaning roller 48 is transparent again to allow the light 46 to penetrate the cleaning layer 48*a* as well. The cleaning layer 48*a* desirably has a high transmittance, for example, about 85% or more, to be able to efficiently allow the light 46 to penetrate the cleaning layer 48*a*. The core member 48*b* is made of metal to reflect the light 46. Hence, the light 46 is emitted from the electric charge removing lamp 43 to an electric charging region 45 via the cleaning layer 48*a* as shown in FIG. 5. The light 46 emitted from the electric charge removing lamp 43 also penetrates the cleaning layer 48*a* and is reflected by the core member 48*b*, thereby reaching the electric charging region 45 at the same time as well. In the process cartridge 40A of the second embodiment of the present invention, the light 46 can be efficiently emitted from the electric charge removing lamp 43 to both of the electric charging regions 44 and 45. Here, even when the electric charging roller cleaning roller 48 does not include the core member 48*b*, the light 46 penetrating the electric charging roller cleaning roller 48 similarly reaches (i.e., is directed onto) the electric charging region 45 as well.

Figure 6:
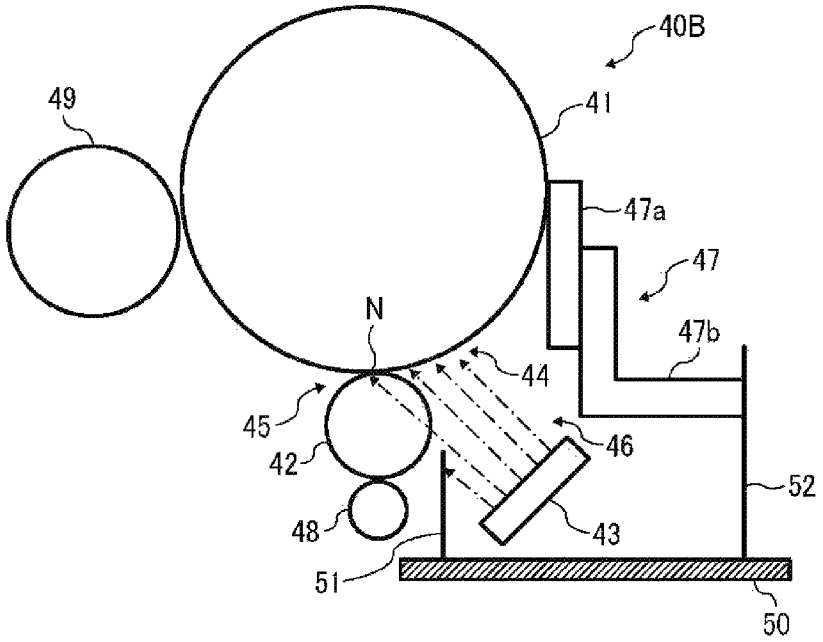
FIG. 6 is a schematic diagram illustrating a principal part of an exemplary process cartridge according to a third embodiment of the present invention.

Now, an exemplary process cartridge according to a third embodiment of the present invention is described with reference to FIG. 6. That is, as shown there, a principal part of the process cartridge 40B according to the third embodiment of the present invention is schematically illustrated. Beside the photoconductive drum 41 and the electric charging roller 42, the process cartridge 40B according to the third embodiment of the present invention includes the cleaner 47 for cleaning the photoconductive drum 41 and the electric charging roller cleaning roller 48 again as in the second embodiment of the present invention. Similarly, in the drawing, the reference numeral 49 also indicates the developing roller included in the developing device again as in the second embodiment of the present invention. The electric charging roller cleaning roller 48 contacts and cleans the electric charging roller 42. The electric charging roller cleaning roller 48 is again transparent to allow the light 46 to penetrate the electric charging roller cleaning roller 48. However, the electric charging roller cleaning roller 48 desirably has a transmittance of 85% or more, for example.

Also, in the third embodiment of the present invention, the electric charging roller 42 similarly accepts penetration of the light 46 as in the first embodiment of the present invention as well. The cleaner 47 also includes the cleaning blade 47*a* that contacts the photoconductive drum 41 and the base portion 47*b* that holds the cleaning blade 47*a*.

The process cartridge 40B also includes the base member 50 but additionally includes a shielding plate (51) mounted on the base member 50 as a shielding device. The shielding plate 51 may prevent the light 46 emitted from the electric charge removing lamp 43 from reaching the electric charging region 45 located downstream of the electric charging nip N. Hence, although the light 46 penetrating the electric charging roller 42 is directed onto the electric charging region 44 located upstream of the electric charging nip N, it is not directed onto the electric charging region 45 located downstream of the electric charging nip N. In the drawing, a reference numeral 52 indicates a stay additionally placed on the base member 50 to hold the cleaner 47.

According to the third embodiment of the present invention, the light 46 can be prevented from penetrating the electric charging roller 42 and accordingly reaching the electric charging region 45, because the electric charging roller 42 generally provides a long optical path that tends to cause uneven transparency. However, the light 46 uniformly reaches the electric charging region 44 at the same time. That is, the electric charge removal and electric charging process can be uniformly executed in the electric charging region 44 at the same time.

Now, an exemplary image forming apparatus according to a fourth embodiment of the present invention is described with reference to FIG. 7. That is, as shown there, an exemplary configuration of the image forming apparatus according to fourth embodiment of the present invention is schematically illustrated. The image forming apparatus 30 according to this embodiment of the present invention is a tandem type color printer configured by arranging four process cartridges 20Y, 20C, 20M, and 20K in a line to form yellow (Y), magenta (M), cyan (C), and black (K) color images, respectively. The process cartridges 20Y, 20C, 20M, and 20K of the respective colors have the same configurations with each other, but use different toner colors from the other. Each of the process cartridges 20Y, 20C, 20M, and 20K includes a configuration as employed in the above-described one of the first to third embodiments of the present invention. That is, each of the process cartridges 20Y, 20C, 20M, and 20K corresponds to one of the process cartridges 40, 40A, and 40B.

Specifically, the yellow process cartridge 20Y includes a photoconductive drum 1Y, an electric charging roller 2Y acting as an electric charging member, and an exposing device 3Y acting as an exposing device. The yellow process cartridge 20Y also includes a developing roller 4Y acting as a developing device, an electric charge removing lamp 6Y acting as an electric charge removing device, and a cleaning blade 7Y acting as a cleaner. Similarly, the cyan process cartridge 20C includes a photoconductive drum 1C, an electric charging roller 2C acting as an electric charging member, and an exposing device 3C acting as an exposing device. The cyan process cartridge 20C also includes a developing roller 4C acting as a developing device, an electric charge removing lamp 6C acting as an electric charge removing device, and a cleaning blade 7C acting as a cleaner. The magenta process cartridge 20M again includes a photoconductive drum 1M, an electric charging roller 2M acting as an electric charging member, and an exposing device 3M acting as an exposing device. The magenta process cartridge 20M also includes a developing roller 4M acting as an developing device, an electric charge removing lamp 6M acting as an electric charge removing device, and a cleaning blade 7M acting as a cleaner. Further, the black process cartridge 20K similarly includes a photoconductive drum 1K, an electric charging roller 2K acting as an electric charging member, and an exposing device 3K acting as an exposing device. The black process cartridge 20K also includes a developing roller 4K acting as an developing device, an electric charge removing lamp 6K acting as an electric charge removing device, and a cleaning blade 7K acting as a cleaner.

Here, each of the photoconductive drums 1Y, 1C, 1M, and 1K included in the process cartridges 20Y corresponds to the photoconductive drum 41 of the process cartridge 40 employed in the first embodiment of the present invention. Each of the electric charging rollers 2Y, 2C, 2M, and 2K similarly corresponds to the electric charging roller 42 employed in the first embodiment of the present invention. Further, each of the electric charge removing lamps 6Y, 6C, 6M, and 6K again corresponds to the electric charge removing lamp 43 employed in the first embodiment of the present invention. Each of the developing rollers 4Y, 4C, 4M, and 4K also corresponds to the developing roller 49 employed in the first embodiment of the present invention as well. Similarly, each of the cleaning blades 7Y, 7C, 7M, and 7K corresponds to the cleaning blade 47*a* employed in the first embodiment of the present invention as well.

Below each of the process cartridges 20Y, 20C, 20M, and 20K, an intermediate transfer belt 5 is positioned to almost contact each of the photoconductive drums 1Y, 1C, 1M, and 1K. Multiple transfer stations are formed, at which multiple intermediate transfer bias rollers 10Y, 10C, 10M, and 10K are disposed opposite the respective photoconductive drums 1Y, 1C, 1M, and 1K across the intermediate transfer belt 5. The intermediate transfer belt 5 is stretched and wound around multiple tightly stretching rollers 11*a*, 11*b*, and 11*c* and a secondary transfer backup roller 12. In the fourth embodiment of the present invention, the tightly stretching roller 11*a* serves as a drive roller.

Here, a shape of each of these photoconductive drums 1Y, 1C, 1M, and 1K is not limited to a drum, and a sheet-like or endless belt-shaped photoconductor can be employed as well, for example. Here, the multiple electric charging rollers 2Y, 2C, 2M, and 2K again permit penetration of light beams emitted from the respective electric charge removing lamps 6Y, 6C, 6M, and 6K as well.

As a light source of each of the multiple exposing devices 3Y, 3C, 3M, and 3K, and each of the multiple electric charge removing lamps 6Y, 6C, 6M, and 6K as well, one of a fluorescent lamp, a tungsten lamp, and a halogen lamp can be used. Also, one of a mercury lamp, a sodium lamp, and a light emitting diode (LED) can be used as a light source of each of the multiple exposing devices 3Y, 3C, 3M, and 3K, and each of the multiple electric charge removing lamps 6Y, 6C, 6M, and 6K as well. Further, one of a laser diode (LD) and an electro-luminescence (EL) or the like can be also used as a light source of each of the multiple exposing devices 3Y, 3C, 3M, and 3K, and each of the multiple electric charge removing lamps 6Y, 6C, 6M, and 6K as well. Further, to only emit a desired wavelength of light, various filters, such as a sharp cut filter, a bandpass filter, and a near-IR (infrared) cut filter, a dichroic filter, an interference filter, a color temperature conversion filter, etc., can be used.

Furthermore, to control the respective electric charge removing lamps 6Y, 6C, 6M, and 6K, multiple controllers (9Y, 9C, 9M, and 9K) are employed. Hence, when the electric charge removing lamps 6Y, 6C, 6M, and 6K are composed of LEDs, desired voltages are output from the controllers to control the LEDs to emit light beams in accordance with the desired voltages, respectively. Each of the controllers can increase a degree of intensity of the light as a working time of each of the electric charge removing lamps 6Y, 6C, 6M, and 6K increases. With this, even when the electric charging rollers 2Y, 2C, 2M, and 2K are stained as are used, electric charges existing at both the electric charging regions 44 and 45 located both upstream and downstream of each of the charging nips N can be effectively removed by a proper amount of light. For this reason, the photoconductive drums 1Y, 1C, 1M, and 1K are not needlessly fatigued by the light beams, respectively.

Although an amount of light increases as time elapses, the controller can decrease a rate of increase of the light of the electric charge removing lamps 6Y, 6C, 6M, and 6K in proportion to an amount of the light shielded by usage toner. That is, the smaller the level at which the light is shielded by the usage toner, the smaller the rate of increase of the light. Hence, since a yellow toner generally shields a less amount of light than a black toner, the rate of increase of the increased amount of light intensity thereof is decreased when the yellow toner is used. The same may go in a situation when cyan toner is used. With this, even when the electric charging roller is dirtied with the toner along with its usage, an electric charge existing in the electric charging nip N (including the upstream and downstream portions thereof) can be effectively removed by a reasonable amount of light. Accordingly, the process cartridges 20Y and 20C storing the respective yellow toner and cyan toner hardly blocking the light 46 are not needlessly fatigued by the light.

Further, the image forming apparatus includes a toner adhesion density detector 8. The toner adhesion density detector 8 is a light reflective type toner adhesion sensor (e.g., a P-sensor). For example, the toner adhesion density detector 8 may employ a diffused reflection type optical sensor having a pair of light emitting and receiving sections. That is, with this, light is emitted from the light emitting section toward a surface of the intermediate transfer belt 5, and an amount of light diffused by a surface of the intermediate transfer belt 5 is detected by the light receiving section, thereby detecting a density of an image formed on the surface of the intermediate transfer belt 5. Then, based on the toner adhesion density detected in this way, an amount of development of the image (i.e., a toner adhering amount) can be obtained. Instead of the toner adhesion density of the surface of the intermediate transfer belt, the toner adhesion density detector 8 can detect the toner adhesion density of a surface of each of the photoconductive drums 1Y, 1C, 1M, and 1K as well, for example.

Although the above-described image forming apparatus 30 is a full-color tandem type, the present invention is not limited to the same and can be also applied to both a black and white (i.e., a monochrome) image forming apparatus and a revolver type image forming apparatus as well. In any one of such modifications, the present invention is similarly implemented therein. Further, although the above-described embodiments of the present invention employ the intermediate transfer type image forming apparatus, a direct transfer system can be also employed as well.

In the process cartridges 20Y, 20C, 20M, and 20K, toner particles included in toner images developed by the respective developing rollers 4Y, 4C, 4M, and 4K and borne on the photoconductive drums 1Y, 1C, 1M, and 1K are transferred onto the intermediate transfer belt 5 one after another. At this moment, however, the toner particles are not completely transferred onto the intermediate transfer belt 5, and some of the toner particles rather remain on the photoconductive drums 1Y, 1C, 1M, and 1K, respectively. In applicable one of the process cartridges 20Y, 20C, 20M, and 20K, when such residual toner particles are not removed on one hand and the next mage forming process is executed on the other hand, an electric charging process becomes insufficient and accordingly latent image formation in an exposing process raises a problem as a result.

Accordingly, to solve the above-described problem the residual toner needs to be removed by a prescribed cleaner in each of the process cartridges 20Y, 20C, 20M, and 20K. As such a cleaner, either each of cleaning blades 7Y, 7C, 7M, and 7K or each of cleaning brushes is used either as a single unit or a combination of the cleaning blade and the cleaning brush. As the cleaning brush, a known member, such as a fur bush, a magnet fur brush, etc., may be used.

Further, as described earlier, the intermediate transfer unit is disposed downstream of each of the developing rollers 4Y, 4C, 4M, and 4K in each of rotation directions of the respective photoconductive drums 1Y, 1C, 1M, and 1K. In the intermediate transfer unit, the intermediate transfer belt 5 is rotated and moved clockwise in the drawing by the tightly stretching roller 11*a* as it is driven and rotated. More specifically, the intermediate transfer belt is wound around the multiple tightly stretching rollers 11*a*, 11*b*, and 11*c*, the multiple intermediate transfer bias rollers 10Y, 10C, 10M, and 10K, and the secondary transfer backup roller 12. Hence, toner images of respective colors of yellow, magenta, cyan, and black visualized (i.e., developed) on the photoconductive drums 1Y, 1C, 1M, and 1K enter the multiple intermediate transfer nips, respectively, in which each of the photoconductive drums 1Y, 1C, 1M, and 1K contacts the intermediate transfer belt 5.

These toner images of respective component colors of yellow, magenta, cyan, and black are then intermediately transferred and superimposed on the intermediate transfer belt 5 under influence of transfer biases applied by the respective intermediate transfer bias rollers 10Y, 10C, 10M, and 10K, thereby collectively forming a four color superimposed (i.e., a full-color) toner image. Such an intermediate transfer system in that the multiple toner images are superimposed by using the intermediate transfer belt can relatively easily position the photoconductors relative to an intermediate transfer member (i.e., the intermediate transfer belt 5), accurately. Thus, the intermediate transfer system is advantageous in view of reduction of color shift.

Figure 7:
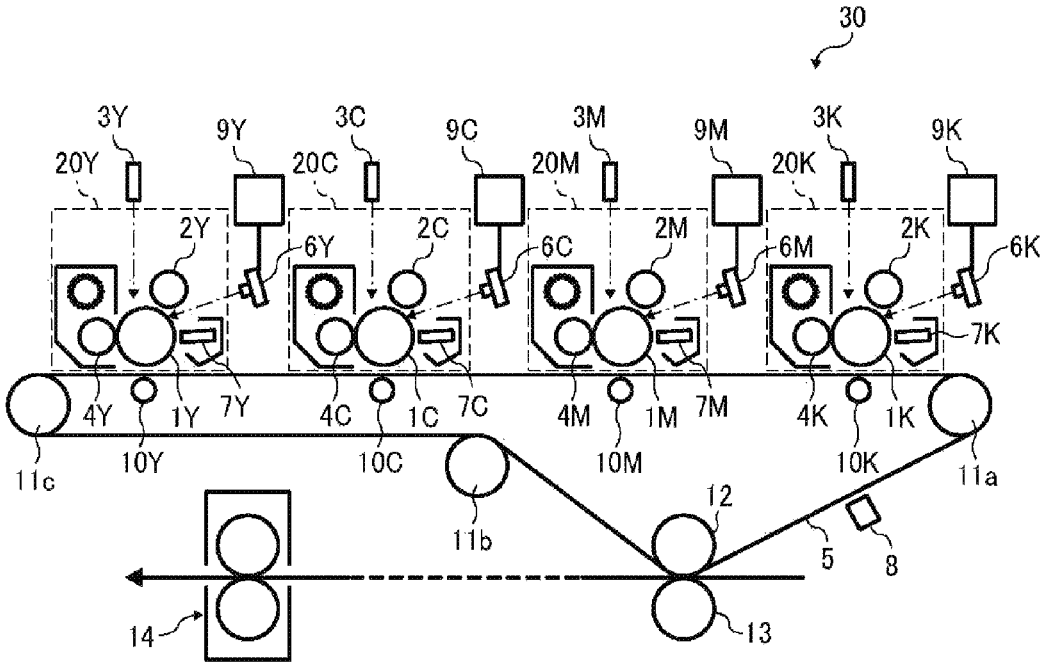
FIG. 7 is a schematic diagram illustrating a configuration of an exemplary image forming apparatus according to a fourth embodiment of the present invention.

Further, as shown in FIG. 7, below the intermediate transfer unit, a secondary transfer unit is located. The secondary transfer unit includes a transfer belt and various types of multiple rollers, such as a paper sheet transfer bias roller 13, a drive roller, etc. In addition, as shown in FIG. 7, on the left side of the secondary transfer unit, a fixing unit 14 is disposed as well. Here, the transfer belt of the secondary transfer unit can be vertically moved by a known moving device in FIG. 7 as well. In such a situation, when one of a single color toner image (e.g., a yellow toner image), a twin-color superimposed toner image, and a trivalent color superimposed toner image borne on the intermediate transfer belt 5 passes through an opposing position opposite to the paper sheet transfer bias roller 13, the transfer belt retracts and moves to a non-contact position to separate from the intermediate transfer belt 5.

By contrast, before a tip of the four color superimposed toner image borne on the intermediate transfer belt 5 enters the opposing position opposite to the paper sheet transfer bias roller 13, the transfer belt moves to a contact position contacting the intermediate transfer belt 5 to form a secondary transfer nip therebetween.

Meanwhile, a pair of positioning rollers (i.e., a pair of registration rollers) sandwiches a recording medium between two rollers thereof when the recording medium recording medium is launched from a paper sheet cassette. The pair of positioning rollers then conveys the recording medium toward the secondary transfer nip at a prescribed time to timely receive the four color superimposed toner image borne the intermediate transfer belt 5. The four color superimposed toner image borne the intermediate transfer belt 5 is secondary transferred on the recording medium at once in the secondary transfer nip under influence of a secondary transfer bias applied by the paper sheet transfer bias roller 13. Hence, with this secondary transfer process, the full-color toner image is formed on the recording medium ultimately.

Subsequently, the recording medium with the full-color toner image thereon moves to the fixing unit 14. The fixing unit 14 receives and coveys the recording medium into a fixing nip formed between a heating roller and a backup roller contacting each other while pinching the recording medium therebetween. The full-color toner image borne on the recording medium is then heat by the heating roller under pressure in the fixing nip thereby firmly fixed into the recording medium.

According to one aspect of the present invention, occurrence of a residual image can be effectively suppressed without increasing a waiting time or the like even when either printing operation is repeated or a residual potential of a photoconductor increases and the like. That is, according to one aspect of the present invention, an electric charging-diselectrifying device includes an electric charging member that contacts an image bearer to form an electric charging nip N between the electric charging member and the image bear. The electric charging member electrically charges multiple electric charge regions in the image bearer located both upstream and downstream of the electric charging nip in a direction of rotation of the image bearer. The electric charging-diselectrifying device also includes an electric charge removing device that emits light and removes electric charge borne on the image bearer by irradiating the multiple electric charging regions of the image bearer with the light. The electric charging member is made of a material that allows the light emitted from the electric charge removing device to penetrate the electric charging member.

Numerous additional modifications and variations of the present invention are possible in light of the above teachings. It is therefore to be understood that within the scope of the appended claims, the present invention may be executed otherwise than as specifically described herein. For example, the electric charging-diselectrifying device is not limited to the above-described various embodiments and modifications and may be altered as appropriate. Further, the process cartridge is not limited to the above-described various embodiments and modifications and may be altered as appropriate. Further, the image forming apparatus is not limited to the above-described various embodiments and modifications and may be altered as appropriate.

What is claimed is:

1. An electric charging-diselectrifying device comprising:

an electric charging member contacting an image bearer to form an electric charging nip between the electric charging member and the image bearer, the electric charging member electrically charging multiple electric charge regions in the image bearer located both upstream and downstream of the electric charging nip in a direction of rotation of the image bearer; and an electric charge removing device to remove electric charge borne on the image bearer by irradiating the multiple electric charging regions of the image bearer with light, wherein the electric charging member is made of a material that allows the light emitted from the electric charge removing device to penetrate the electric charging member.

2. The electric charging-diselectrifying device as claimed in claim 1, wherein a light transmittance of the electric charging member that allows penetration of the light is about 10% or more.

3. The electric charging-diselectrifying device as claimed in claim 2, wherein the electric charge removing device irradiates the electric charging nip with light having an intensity of about 450 $mW/m^2$.

4. The electric charging-diselectrifying device as claimed in claim 1, wherein the electric charge removing device irradiates the electric charging region formed upstream of the electric charging nip in the image bearer with the light directly and the electric charging region formed downstream of the electric charging nip in the image bearer via the electric charging member at the same time with the light penetrating the electric charging member.

5. The electric charging-diselectrifying device as claimed in claim 1, wherein the electric charging member has a surface overlay film containing transparent fine insulation particles.

6. The electric charging-diselectrifying device as claimed in claim 5, wherein a carbon content of the electric charging member is from about 10% to about 70% and an error of a thickness of the overlay film is about ±2 μm or less.

7. The electric charging-diselectrifying device as claimed in claim 1, wherein the electric charging member is a roller having a base material made of polyurethane.

8. The electric charging-diselectrifying device as claimed in claim 1, wherein the electric charging member has a uniform transmittance to allow the light to uniformly penetrate the electric charging member.

9. The electric charging-diselectrifying device as claimed in claim 1, further comprising an electric charging member cleaner to contact and clean the electric charging member, wherein the electric charging member cleaner is made of transparent material to allow the light to penetrate the electric charging member cleaner.

10. The electric charging-diselectrifying device as claimed in claim 9, wherein the electric charging member cleaner has a transmission rate of about 85% or more.

11. The electric charging-diselectrifying device as claimed in claim 9, wherein the electric charging member cleaner includes a core member to reflect the light toward the electric charging region located at least one of the upstream and downstream of the electric charging nip in the image bearer.

12. The electric charging-diselectrifying device as claimed in claim 1, wherein an amount of light is increased as an operation time of the electric charging-diselectrifying device increases.

13. The electric charging-diselectrifying device as claimed in claim 12, wherein a rate of increase of the amount of light as the operation time of the electric charging-diselectrifying device increases is decreased as an amount of light blocked by toner decreases.

14. The electric charging-diselectrifying device as claimed in claim 1, further comprising a shielding device to prevent the light emitted from the electric charge removing device from reaching the electric charging region formed downstream of the electric charging nip in the direction of rotation of the image bearer.

15. A process cartridge detachably attachable from and to a main unit of an image forming apparatus as a single unit, the process cartridge comprising:

an image bearer to bear an electrostatic latent image thereon;

the electric charging-diselectrifying device as claimed in claim 1; and at least one of a developing device to render the electrostatic latent image visible as a toner image on the image bearer, a transfer device to transfer the toner image onto a recording medium, and a cleaner to clean the image bearer after the transfer device transfers the toner image onto the recording medium.

16. An image forming apparatus comprising:

an image bearer to bear an electrostatic latent image thereon;

a developing device to render the electrostatic latent image visible as a toner image on the image bearer; and the electric charging-diselectrifying device as claimed in claim 1.

17. The image forming apparatus as claimed in claim 16, further comprising:

an exposing device to expose the image bearer to exposure light; and a toner adhesion density detector to detect toner adhesion density in a toner image, wherein a difference in toner adhesion density of a first halftone toner image and a second halftone toner image detected by the toner adhesion density detector is about 0.02 or less when the light transmittance of the electric charging member is about 10% or more, wherein the first halftone toner image is obtained by developing an electrostatic latent image formed again by the exposing device on an identical surface portion of the image bearer, at which an electrostatic latent image is previously formed by the exposing device in a latest rotation of the image bearer, wherein the second halftone toner image is obtained by developing an electrostatic latent image formed by the exposing device in a different surface portion of the image bearer, at which an electrostatic latent image is not previously formed by the exposing device in the latest rotation of the image bearer.

18. The image forming apparatus as claimed in claim 16, wherein the toner adhesion density detector detects toner adhesion density of the toner image when the image forming apparatus is not forming an image.

19. The image forming apparatus as claimed in claim 16, wherein a rate of increase of an amount of light as an operation time of the electric charging-diselectrifying device increases is decreased when the light is blocked by yellow toner in the electric charging nip than when the light is blocked by black toner in the electric charging nip.

20. The image forming apparatus as claimed in claim 16, wherein the image bearer that bears an electrostatic latent image thereon, the developing device that renders the electrostatic latent image visible as a toner image on the image bearer, and the electric charging-diselectrifying device are mounted on a process cartridge detachably attachable from and to a main unit of the image forming apparatus as a single unit.

* * * * *